US005540980A

United States Patent [19]

Tolbert et al.

[11] Patent Number: 5,540,980

[45] Date of Patent: Jul. 30, 1996

[54] FIRE RESISTANT FABRIC MADE OF BALANCED FINE CORESPUN YARN

[75] Inventors: Thomas W. Tolbert, Fort Mill, S.C.; William M. Cooke, Charlotte, N.C.; James E. Hendrix, Spartanburg, S.C.

[73] Assignee: Springs Industries, Inc., Fort Mill, S.C.

[21] Appl. No.: 319,323

[22] Filed: Oct. 6, 1994

Related U.S. Application Data

[63] Continuation of Ser. No. 167,434, Dec. 14, 1993, abandoned, which is a continuation of Ser. No. 42,454, Apr. 5, 1993, abandoned, which is a continuation of Ser. No. 784,639, Oct. 28, 1991, abandoned, which is a continuation of Ser. No. 697,488, May 2, 1991, abandoned, which is a continuation of Ser. No. 413,168, Sep. 26, 1989, abandoned, which is a division of Ser. No. 318,239, Mar. 3, 1989, Pat. No. 4,921,756.

[51] Int. Cl.[6] ..... B32B 7/02

[52] U.S. Cl. ..... 428/215; 428/229; 428/252; 428/253; 428/268; 428/318.6; 428/319.7; 428/921

[58] Field of Search ..... 428/215, 229, 428/252, 253, 268, 318.6, 319.7, 921

[56] References Cited

U.S. PATENT DOCUMENTS

| | | | |
|---|---|---|---|
| 3,366,001 | 1/1968 | Meserole | 57/210 |
| 3,439,491 | 4/1969 | Scruggs | 57/5 |
| 3,572,397 | 3/1971 | Austin | 139/426 |
| 3,729,920 | 5/1973 | Sayers et al. | 57/144 |
| 3,886,015 | 5/1975 | Turner | 428/373 |
| 3,913,309 | 10/1975 | Chiarottó | 57/144 |
| 4,024,700 | 5/1977 | Drummond | 57/144 |
| 4,299,884 | 11/1981 | Payen | 428/377 |
| 4,331,729 | 5/1982 | Weber | 428/252 |
| 4,381,639 | 5/1983 | Kress | 57/229 |
| 4,500,593 | 2/1985 | Weber | 428/257 |
| 4,502,364 | 3/1985 | Zucker et al. | 428/373 |
| 4,541,231 | 9/1985 | Graham, Jr. et al. | 57/12 |
| 4,670,327 | 6/1987 | Weber | 428/257 |
| 4,868,041 | 9/1989 | Yamagishi et al. | 428/377 |
| 4,921,756 | 5/1990 | Tolbert et al. | 428/373 |
| 4,921,763 | 5/1990 | Tolbert et al. | 428/373 |
| 4,927,698 | 5/1990 | Jaco et al. | 428/262 |

FOREIGN PATENT DOCUMENTS

| | | |
|---|---|---|
| 0059585 | 10/1982 | Japan . |
| 0100323 | 1/1983 | Japan . |
| 0107608 | 6/1985 | Japan . |
| 0261330 | 11/1986 | Japan . |
| 0141041 | 6/1989 | Japan . |
| 1593048 | 7/1981 | United Kingdom . |

*Primary Examiner*—Christopher W. Raimund
*Attorney, Agent, or Firm*—Bell, Seltzer, Park & Gibson, P.A.

[57] ABSTRACT

Fine textured fire resistant flame barrier fabrics for use as mattress and pillow ticking, bedspreads, mattress covers, draperies, upholstery, protective apparel, tenting, awnings, field fire shelters, for use as a substrate or backing for coated upholstery fabrics and as a flame barrier for use beneath upholstery fabric. The fabric is formed from a corespun yarn comprising a high temperature resistant continuous filament fiberglass core and a low temperature resistant staple fiber sheath surrounding the core. The core comprises about 20% to 40% of the total weight of the corespun yarn while the sheath comprises about 80% to 60% of the total weight of the corespun yarn. The total size of the corespun yarn is within the range of about 43/1 to 3.5/1 conventional cotton count. This corespun yarn may be woven and knit in fine, non-plied form and extends the range of fineness of fabrics below heretofore achievable limits.

9 Claims, 3 Drawing Sheets

FIRE RESISTANT FABRIC MADE OF BALANCED FINE CORESPUN YARN

This application is a continuation of application Ser. No. 08/167,434 filed Dec. 14, 1993, now abandoned, which is a continuation of application Ser. No. 08/042,454 filed Apr. 5, 1993, now abandoned, which is a continuation of application Ser. No. 07/784,639, (Oct. 28, 1991), now abandoned, which is a continuation of application Ser. No. 07/697,488 (May 2, 1991), now abandoned which is a continuation of application Ser. No. 07/413,168, (Sep. 26, 1989) now abandoned, which is a division of application Ser. No. 318,239, filed Mar. 3, 1989, now U.S. Pat. No. 4,921,756.

FIELD OF THE INVENTION

This invention relates generally to a fire resistant flame durable balanced or nonlively fine corespun yarn with a high temperature resistant continuous filament fiberglass core and a low temperature resistant staple fiber sheath surrounding the core, and more particularly to such a yarn which is suitable for use in forming fine textured fire resistant flame barrier fabrics for use as mattress and pillow ticking, as bedspreads, as pillow slip covers, as draperies, as mattress covers, as sleeping bag covers, as wall coverings, as decorative upholstery, as a substrate or backing for coated upholstery fabric, as a flame barrier for use beneath upholstery fabric, as tenting, as awnings, as tension span structures, and as protective apparel and field fire shelters for persons exposed to fires in their immediate environments.

BACKGROUND OF THE INVENTION

It is known to produce fire resistant fabrics for use as mattress tickings, bedspreads and the like by using yarn formed of natural or synthetic fibers and then treating the fabric with fire retarding chemicals, such as halogen-based and/or phosphorus-based chemicals. This type of fabric is heavier than similar types of non-fire retardant fabrics, and has a limited wear life. Also, this type of fabric typically melts or forms brittle chars which break away when the fabric is burned.

It is also known to form fire resistant fabrics of fire resistant relatively heavy weight yarns in which a low temperature resistant fiber is ring spun around a core of continuous filament fiberglass. However, this type or ring spun yarn has torque imparted thereto during the spinning process and is very lively. Because of the lively nature of the yarn, it is necessary to ply "S" and "Z" ring spun yarns together so that the torque and liveliness in the yarn is balanced in order to satisfactorily weave or knit the yarn into the fabric, without experiencing problems of tangles occurring in the yarn during the knitting or weaving process. This plying of the "S" and "Z" yarns together results in a composite yarn which is so large that it cannot be used in the formation of fine textured, lightweight fabrics. In some instances the fiberglass filaments in the core protrude through the natural fiber sheath. It is believed that the problem of protruding core fibers is associated with the twist, torque and liveliness being imparted to the fiberglass core during the ring spinning process.

It is the current practice to produce coated upholstery fabrics by weaving or knitting a substrate or scrim of a cotton or cotton and polyester blend yarn. This scrim is then coated with a layered structure of thermoplastic polyvinyl halide composition, such as PVC. This coated upholstery fabric has very little, if any, fire resistance and no flame barrier properties.

SUMMARY OF THE INVENTION

With the foregoing in mind, it is an object of the present invention to provide a fire resistant balanced fine or relatively light weight flame durable corespun yarn suitable for use in forming fine textured flame barrier fabrics for use as mattress and pillow ticking, as bedspreads, as draperies, as mattress covers, as wall coverings, as decorative upholstery, as a flame barrier substrate or backing for coated upholstery fabric, as a flame barrier for use beneath upholstery fabrics, as tenting, as awnings, and as protective apparel and field fire shelters for persons exposed to fires in their immediate environments. The corespun yarn includes a high temperature resistant continuous filament fiberglass core and a low temperature resistant staple fiber sheath surrounding the core so that it is not necessary to ply pairs of these yarns together to obtain a balance of twist. The present torque or twist balanced yarn also reduces the problem of protruding fiberglass filaments of the core extending through the staple fiber sheath.

In the corespun yarn in accordance with the present invention, the continuous filament fiberglass core comprises about 20% to 40% of the total weight of the corespun yarn while the sheath of staple fibers comprises about 80% to 60% of the total weight of the corespun yarn. The total size of the nonlively nonplied fine corespun yarn is within the range of about 43/1 to 3.5/1 conventional cotton count. The staple fibers of the sheath surrounding the core may be either natural or synthetic, such as cotton, polyester, wool, or blends of these fibers.

The fine count balanced corespun yarn of the present invention is preferably formed on a Murata air jet spinning apparatus in which a sliver of low temperature resistant fibers is fed through the entrance end of a feed trumpet and then passes through a drafting section. A continuous filament fiberglass core is fed on top of the staple fibers at the last draw rolls and both pass through oppositely directed first and second air jet nozzles. The corespun yarn is then wound onto a take-up package. The air jet nozzles cause the sheath of low temperature resistant fibers to surround and completely cover the core so that the yarn and the fabric produced therefrom have the surface characteristics of the staple fibers forming the sheath while the yarn has very little, if any, twist, torque and liveliness. The balanced characteristics of the corespun yarn permit the yarn to be knit or woven in a single end or nonplied manner without imparting an objectionable amount of torque to the fabric, and without presenting problems of tangles occurring in the yarn during the knitting or weaving process.

When fabrics which have been formed of the balanced corespun yarn of the present invention are exposed to flame and high heat, the sheath of low temperature resistant staple fibers surrounding and covering the core are charred and burned but remain in position around the fiberglass core to provide a thermal insulation barrier. The fiberglass core remains intact after the organic staple fiber materials have burned and forms a lattice upon which the char remains to block flow of oxygen and other gases while the survival of the supporting lattice provides a structure which maintains the integrity of the fabric after the organic materials of the staple fiber sheath have been burned and charred. Chemical treatments may be added to the fibers of the sheath to enhance the formation of charred residue, in preference to ash.

Fabrics woven or knit of the corespun yarn of the present invention may be dyed and printed with conventional dyeing and printing materials since the outer surface characteristics of the yarn, and the fabric formed thereof, are determined by the sheath of low temperature resistant staple fibers surrounding and covering the core. These fabrics are particularly suitable for forming fine textured fire resistant flame barrier fabrics for use as mattress or pillow ticking, mattress covers, bedspreads, draperies, protective apparel, field fire shelters, and the like.

The fire resistant balanced or nonlively corespun yarn of the present invention is also particularly suitable for use as a substrate or backing for flocked suedes and velvets in which flock is deposited onto an adhesive carried by the fabric. This yarn is also useful for a substrate or backing for coated upholstery fabrics, such as Naugahyde®. These coated upholstery fabrics are used to cover foam cushions of the type used in chairs, sofas, and seats for automobiles, airplanes and the like. This type of coated upholstery fabric typically includes a layered structure of thermoplastic polyvinyl halide composition including a top or skin coat formulated of PVC, acrylic, urethane or other composition, a PVC foam layer, and a fabric backing, substrate, or scrim. When the scrim formed of the fire resistant corespun yarn of the present invention is employed in this type of coated upholstery fabric, the PVC layers will burn and char in the presence of a flame but the core of the scrim does not burn nor rupture and provides an effective flame barrier to prevent penetration of the flame through the fabric to the cushioning material therebeneath.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENTS

Figure 1:
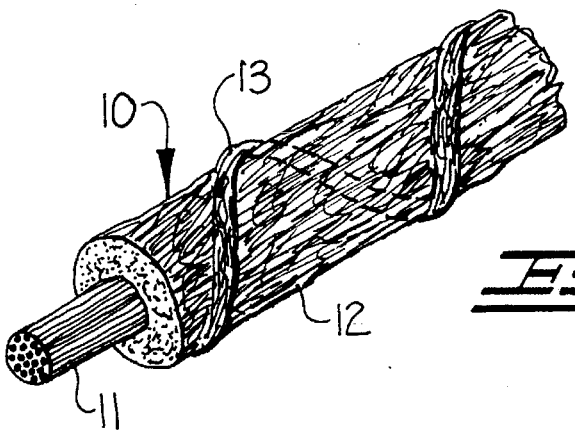
FIG. 1 is a greatly enlarged view of a fragment of the balanced corespun yarn of the present invention with a portion of the sheath being removed at one end thereof.

The fire resistant balanced corespun yarn of the present invention, broadly indicated at 10 in FIG. 1, includes a core 11 of high temperature resistant continuous filament fiberglass, and a sheath 12 of low temperature resistant staple fibers surrounding and covering the core 11. As illustrated in FIG. 1, the continuous fiberglass filaments of the core 11 extend generally in an axial direction and longitudinally of the corespun yarn 10 while the majority of the staple fibers of the sheath 12 extend in a slightly spiraled direction around the core 11. A minor portion of the staple fibers may be separated and form a binding wrapper spirally wrapped around the majority of the staple fibers, as indicated at 13. Since the sheath 12 of low temperature resistant staple fibers surrounds and completely covers the core 11, the outer surface of the yarn has the appearance and general characteristics of the low temperature resistant staple fibers forming the sheath 12.

The low temperature resistant staple fibers of the sheath 12 may be selected from a variety of different types of either natural (vegetable, mineral or animal) or synthetic (man-made) fibers, such as cotton, wool, polyester, modacrylic, nylon, rayon, acetate, or blends of these fibers. In the examples given below, the preferred low temperature resistant staple fibers are either cotton or polyester.

The core 11 of high temperature resistant continuous filament fiberglass comprises about 20% to 40% of the total weight of the corespun yarn 10 while the sheath 12 of low temperature resistant staple fibers surrounding and covering the core 11 comprises about 80% to 60% of the total weight of the corespun yarn 10. The particular percentages of the continuous filament fiberglass and the low temperature resistant staple fibers provided in the corespun yarn for forming particular fabrics will be set forth in the examples given below. In these instances, the total size of the fine corespun yarn 10 is within the range of about 21/1 to 10/1 conventional cotton count, although the practical range of this technology is significantly wider; for example, from 43/1 to 3.5/1 conventional cotton count.

Figure 2:
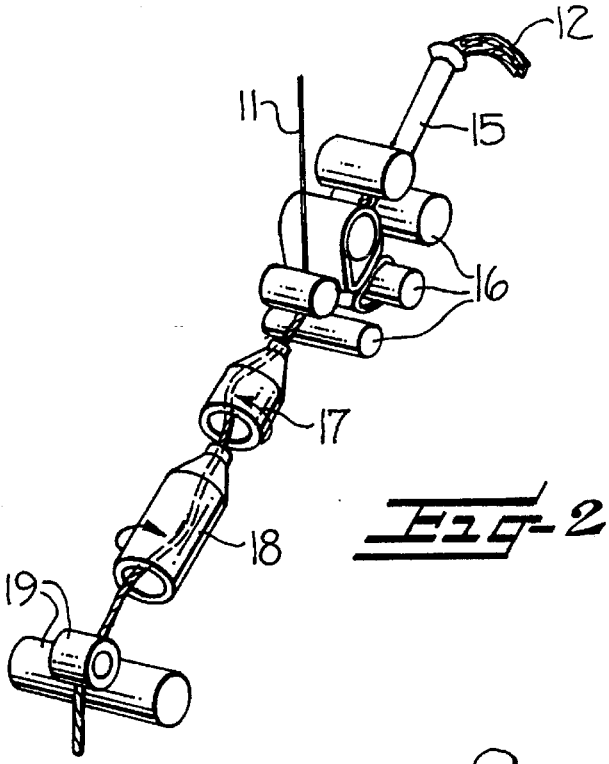
FIG. 2 is a fragmentary schematic isometric view of a portion of a Murata air jet spinning apparatus of the type utilized in forming the fine denier corespun yarn of the present invention.

As pointed out above, the corespun yarn 10 of the present invention is preferably produced on a Murata air jet spinning apparatus of the type illustrated schematically in FIG. 2. The Murata air jet spinning apparatus is disclosed in numerous patents, including U.S. Pat. Nos. 4,718,225; 4,551,887; and 4,497,167. As schematically illustrated in FIG. 2, the air jet spinning apparatus includes an entrance trumpet 15 into which a sliver of low temperature resistant staple fibers 12 is fed. The staple fibers are then passed through a set of drafting rolls 16, and a continuous filament fiberglass core 11 is fed between the last of the paired drafting rolls and onto the top of the staple fibers. The fiberglass core and staple fibers then pass through a first fluid swirling air jet nozzle 17, and a second fluid swirling air jet nozzle 18. The spun yarn is then drawn from the second fluid swirling nozzle 18 by a delivery roll assembly 19 and is wound onto a take-up package, not shown. The first and second fluid swirling nozzles or air jets 17, 18 are constructed to produce swirling fluid flows in opposite directions, as schematically illustrated in FIG. 2. The action of the oppositely operating air jets 17, 18 causes a minor portion of the staple fibers to separate and wind around the unseparated staple fibers and the wound staple fibers maintain the sheath 12 in close contact surrounding and covering the core 11.

The following nonlimiting examples are set forth to demonstrate some of the types of corespun yarns which have been produced in accordance with the present invention. These examples also demonstrate some of the various types of fire resistant flame barrier fabrics which have been formed of these fire resistant nonlively fine denier corespun yarns.

EXAMPLE 1

High temperature resistant continuous filament fiberglass 11, having a weight necessary to achieve 37% in overall yarn weight, is fed between the last of the paired drafting rolls 16, as illustrated in FIG. 2. At the same time, a sliver of low temperature resistant cotton fibers, having a weight necessary to achieve 63% in overall yarn weight, is fed into the entrance end of the trumpet 15. The cotton sliver has a weight of 45 grains per yard and the fiberglass core is ECD 225 1/0 (equivalent to 198 denier). The cotton portion of the resulting yarn has undergone a draft ratio (weight per unit length of sliver divided by weight per unit length of cotton fraction of yarn) of 86. The nonlively fine corespun yarn achieved by this air jet spinning process has a 10/1 conventional cotton count and is woven in both the filling and warp to form a 9.6 ounce per square yard, two up, one down, right-hand twill weave fabric, of the type generally illustrated in FIG. 3.

Figure 3:
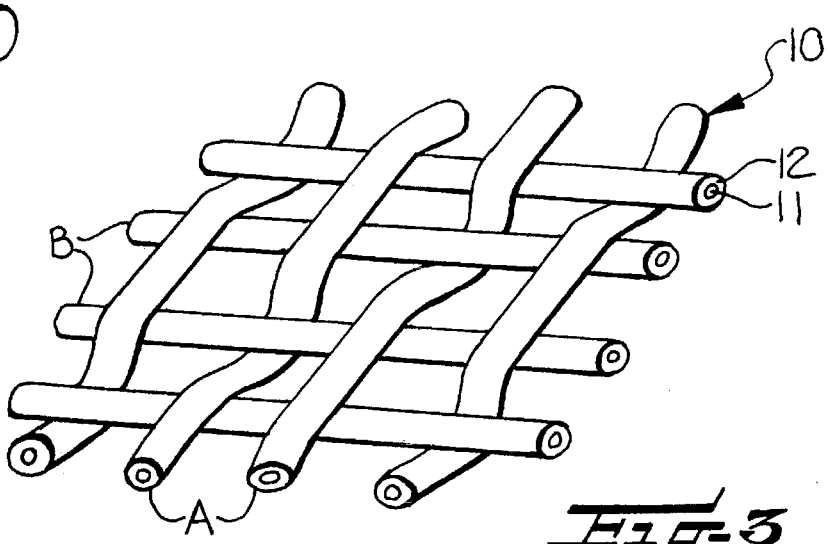
FIG. 3 is a greatly enlarged fragmentary isometric view of a portion of one type of fabric woven of the yarn of the present invention.

This woven fabric is illustrated in FIG. 3 as being of an open weave in order to show the manner in which the warp yarns A and the filling yarns B are interwoven. However, the actual fabric is tightly woven, having 85 warp yarns per inch and 37 filling yarns per inch. This fabric is particularly suitable for use as mattress ticking and may be dyed, subjected to a topical fire resistant chemical treatment, and then subjected to a conventional durable press resin finish, if desired. This mattress ticking fabric has the feel and surface characteristics of a similar type of mattress ticking formed of 100% cotton fibers while having the desirable fire resistant and flame barrier characteristics not present in mattress ticking fabric formed entirely of cotton fibers.

When this fire resistant flame barrier mattress ticking fabric is subjected to a National Fire Prevention Association Test Method (NFPA 701), which involves exposure of a vertical sample to a 12 second duration Bunsen burner flame, the fabric exhibits char lengths of less than 1.5 inches with no afterflame nor afterglow. In accordance with Federal Test Method 5905, a vertical burn of two 12 second exposures to a high heat flux butane flame shows 22% consumption with 0 seconds afterflame, as compared with 45% consumption and 6 seconds afterglow for a similar type of fabric of similar weight and construction formed entirely of cotton fibers and having a fire resistant chemical treatment. Throughout all burn tests, the areas of the fabric char remain flexible and intact, exhibiting no brittleness, melting, nor fabric shrinkage. Although the sheath of cotton fibers is burned and charred, the charred portions remain in position surrounding the core of high temperature resistant continuous filament fiberglass to provide a thermal insulation barrier and to limit movement of vapor through the fabric, while the fiberglass core provides a matrix or lattice which prevents rupture of the mattress ticking and penetration of the flame through the mattress ticking and onto the material of which the mattress is formed.

EXAMPLE 2

Figure 6:
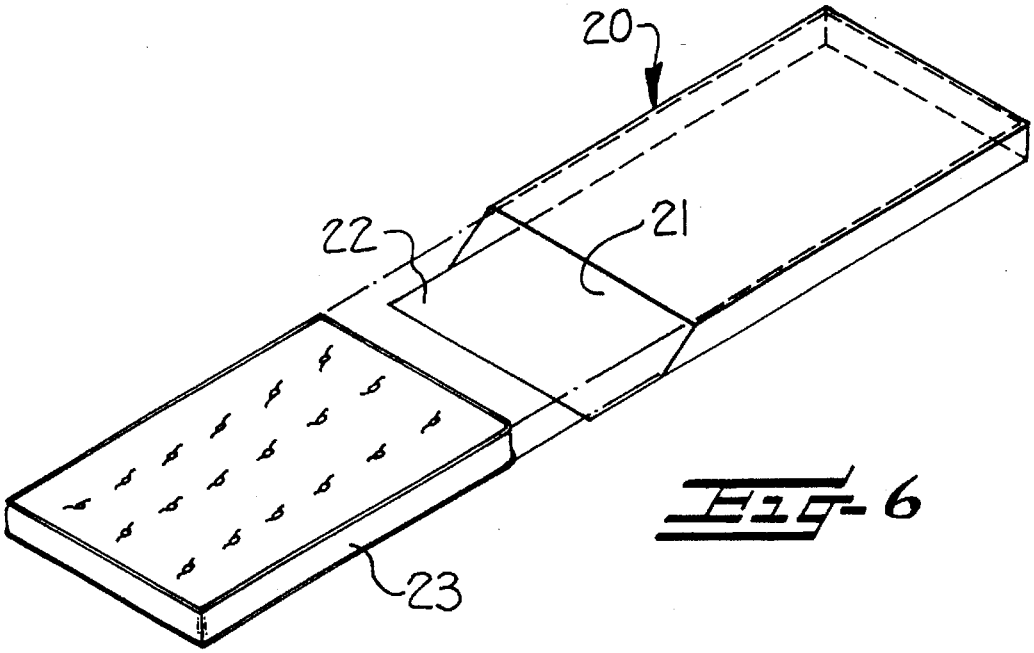
FIG. 6 is an exploded isometric view of a conventional mattress with a mattress cover formed of a fabric produced with the yarn of the present invention.

A mattress ticking fabric is formed of the corespun yarn, as set forth in Example 1. This mattress ticking fabric is then formed into a mattress cover, as broadly indicated at 20 in FIG. 6. The mattress cover 20 includes an open mouth 21 at one end with a fold-in flap 22 extending outwardly therefrom. A conventional mattress, indicated at 23, can then be inserted in the mattress cover 20 and the flap 22 is tucked in over the end of the mattress 23 so that the mattress cover 20 provides a flame barrier around the mattress 23 to prevent penetration of the flame through the mattress cover 20 and onto the material of which the mattress is formed. By the use of the mattress cover 20, the conventional type of mattress 23 can be protected from fire and flame.

EXAMPLE 3

A fire resistant bedspread fabric is produced with the corespun yarn of the present invention by feeding high temperature resistant continuous filament fiberglass 11 between the last of the paired drafting rolls 16, as illustrated in FIG. 2. The fiberglass core is designated as ECD 450 1/0 (equivalent to 99 denier) and having a weight necessary to achieve 39% in overall weight. At the same time, a sliver of low temperature resistant staple cotton fibers having a weight of 30 grains per yard is fed into the entrance trumpet 15, and having a weight necessary to achieve 61% in overall yarn weight after undergoing a draft ratio of 124.

Figure 4:
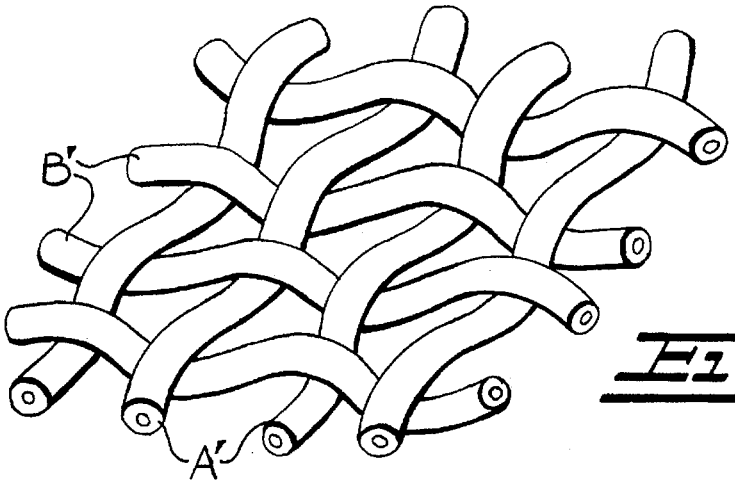
FIG. 4 is a view similar to FIG. 3 but illustrating another type of fabric woven of the yarn of the present invention.

The resulting nonlively fine corespun yarn 10 has a 21/1 conventional cotton count and is then woven in a plain weave configuration in both the warp yarns A' and the filling yarns B', as illustrated in FIG. 4. The corespun yarn 10 is woven with 60 warp yarns and 46 filling yarns per inch to form a 4.75 ounce per square yard fabric. This woven fabric may be finished, then fiber reactive dye printed, treated with a topical fire resistant chemical treatment, afterwashed, and sanforized. This fabric is then subjected to the same flame test methods as described in connection with Example 1, and the fire resistance is the same. Although the low temperature resistant cotton fibers forming the sheath are burned and become charred, the charred portion remains in position surrounding the core of the high temperature resistant fiber. This bedspread provides a flame barrier covering the sheets and mattress and thereby aids in preventing the spread of fire.

EXAMPLE 4

Figure 7:
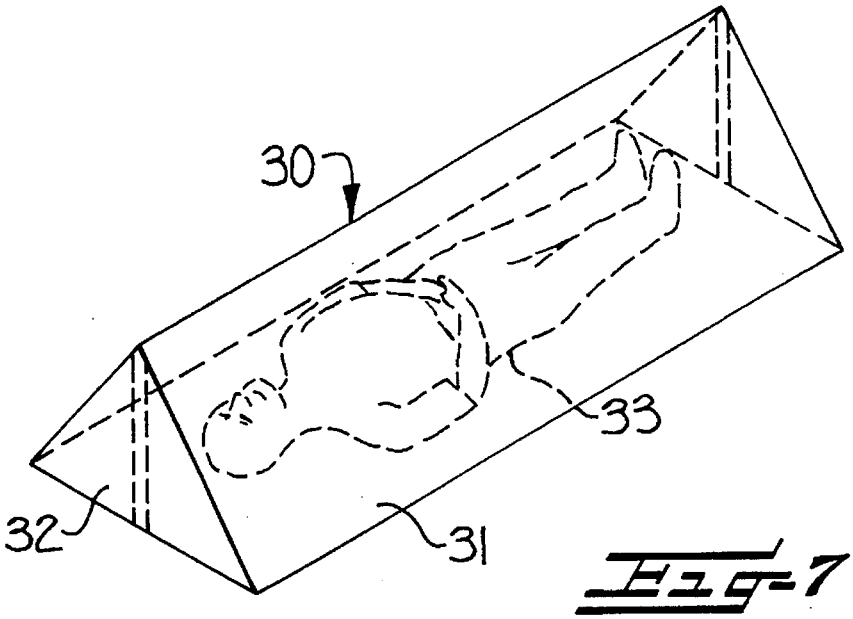
FIG. 7 is an isometric view of a field fire shelter formed of a fabric produced with the yarn of the present invention.

A fabric, similar to the bedspread fabric of Example 3, is formed of the corespun yarn. This fabric is then formed into a field fire shelter, of the type broadly indicated at 30 in FIG. 7. The field fire shelter 30 may include inwardly tapering side walls 31 and end walls 32 of a sufficient size to completely cover a person 33 positioned in the shelter. The field fire shelter 30 can be folded or rolled in a compact manner so that it can be easily carried by a forest or brush fire fighter. If the fire fighter is trapped by the burning material surrounding, the field fire shelter 30 can be quickly erected and provide a temporary shelter to prevent penetration of the flame through the field fire shelter 30. The field fire shelter 30 may, for example, be of the type illustrated and described in U.S. Department of Agriculture Forest Service Specification No. 5100-320E.

EXAMPLE 5

Figure 5:
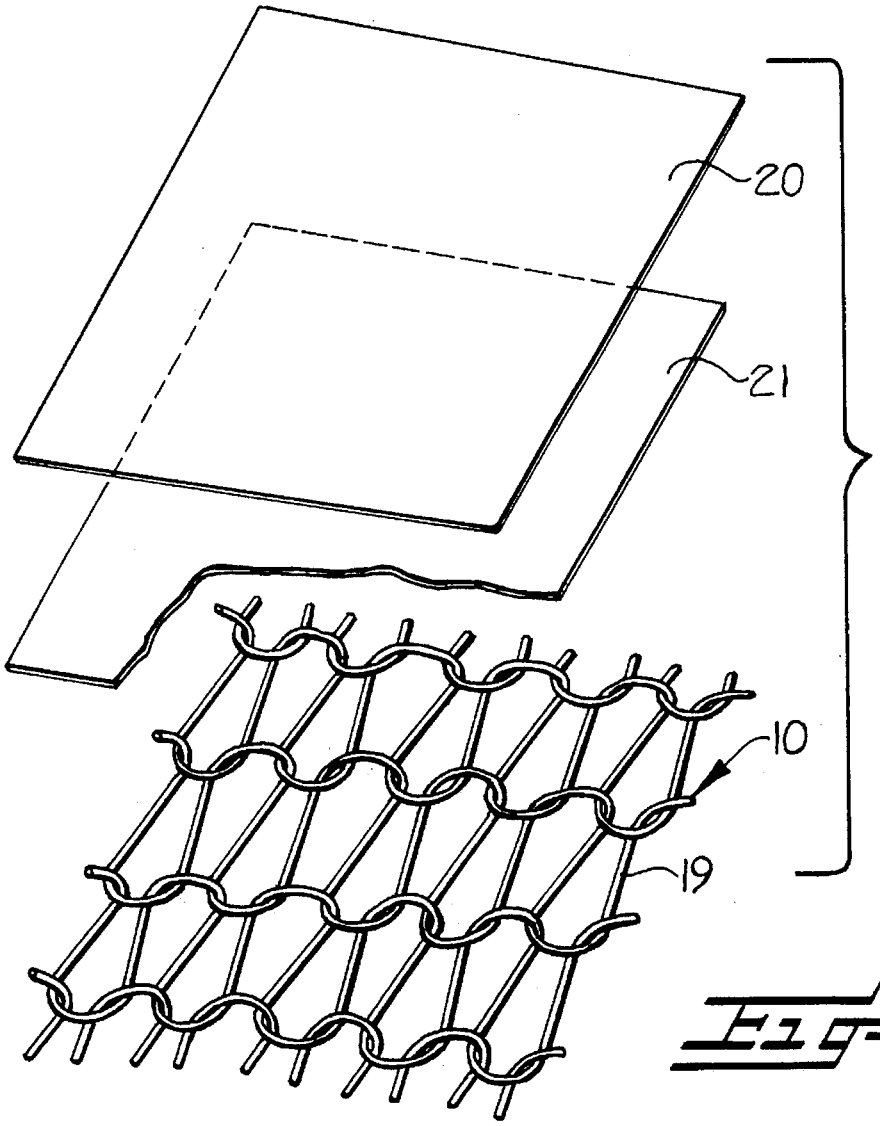
FIG. 5 is an enlarged exploded isometric view of a coated upholstery fabric including a substrate or backing fabric knit of the yarn of the present invention.

A substrate or backing for a coated upholstery fabric is formed of the corespun yarn of the present invention, as illustrated at 19, in FIG. 5. The fabric backing or scrim 19 is formed of the corespun yarn 10 by feeding high temperature resistant continuous filament fiberglass 11 between the last of the paired drafting rolls 16, as illustrated in FIG. 2. The fiberglass core 11 is designated as ECD 450 1/0 (equivalent to 99 denier) and has a weight necessary to achieve 39% in overall yarn weight. At the same time, a sliver of low temperature resistant staple polyester fibers having a weight of 30 grains per yard is fed into the entrance end of the trumpet 15 to achieve 61% in overall yarn weight after drafting (draft ratio of 124).

This corespun yarn 10 has a 21/1 conventional cotton count and is knit in a plain jersey knit construction forming successive courses of wales of stitch loops, as illustrated in the lower portion of FIG. 5. The plain jersey knit fabric 19 has a weight of 2.8 ounces per square yard and contains 25.6 wales per inch and 17 courses per inch. This knit fabric is coated with a layered structure of thermoplastic polyvinyl halide composition including a top layer of plasticized PVC of between 5 to 10 mils, as indicated at 20 in FIG. 5. Beneath this top layer 20, an intermediate layer of foamed PVC of from about 15 to 40 mils is provided, as indicated at 21. Thus, the combined thickness of the top layer 20 and the intermediate layer 21 is between about 20 and 50 mils. The material then may be taken from the coater to a printing operation where one or more layers of print are added to the top layer 20 and a protective top coat may be added at the end of the printing stage.

While the PVC coating material will burn in the presence of a flame and form a residual char, that char is not sufficient to form a flame barrier by itself. The polyester fibers forming the sheath of low temperature resistant staple fibers surrounding and covering the core can burn and can form additional char. The residual fiberglass cores form a flame durable barrier lattice or scrim which prevents the rupture of the upholstery and the entry of the flame through the fabric and into the cushioning material which is covered by the upholstery fabric. The glass fibers of the corespun yarn do not burn and they maintain the integrity of the fabric so that a flame barrier is provided to prevent the entry of the flame to the cushioning material which is covered by the upholstery fabric. Throughout all burn tests, the areas of the fabric char remain intact, exhibiting no melting, dripping or the like.

In the above example, the fabric backing or scrim is described as having a top or face coating applied thereto. However, it is to be understood that back-coated fabrics may also be provided in which the fabric may be provided with a decorative face. Either single or multiple coatings may be applied to either or both surfaces of a non-decorative fabric formed of the corespun yarn of the present invention. The coating may be applied to the back surface of upholstery, apparel or bedding fabrics.

All of the examples of the fire resistant nonlively corespun yarn of the present invention, as disclosed in forming the particular fire resistant flame barrier fabrics described, include a core of high temperature resistant continuous filament fiberglass comprising about 20% to 40% of the total weight of the corespun yarn, and a sheath of low temperature resistant staple fibers surrounding and covering the core and comprising about 80% to 60% of the total weight of the corespun yarn. The fact that the present corespun yarn is balanced and has very little if any torque or liveliness enables the present corespun yarn to be woven or knitted in a single end manner without requiring that two ends be plied to balance the torque so that fine textured fabrics can be formed from the present corespun yarn. Since the formation of the present yarn on an air jet spinning apparatus does not impart excessive liveliness and torque to the fiberglass core, no problems are experienced with loose and broken ends of the fiberglass core protruding outwardly through the sheath in the yarn and the fabrics produced therefrom. Since it is possible to produce woven and knitted fabrics utilizing single ends of the corespun yarn, the corespun yarn can be woven and knitted into fine textured fabrics with the corespun yarn being in the range of from about 43/1 to 3.5/1 conventional cotton count. This extends the range of fineness of fabrics which may be produced relative to the types of fabrics heretofore possible to produce by utilizing only corespun yarns of the prior art.

The fire resistant balanced corespun yarn of the present invention is particularly suitable for use in forming fine textured fire resistant flame barrier fabrics for use as mattress and pillow ticking, mattress covers, bedspreads, draperies, protective apparel, field fire shelters, and the like. This yarn is also suitable for use as a substrate, backing or scrim for coated upholstery fabrics, such as Naugahyde® and the like, as well as other coated fabrics, such as flocked suedes and velvets in which the flock is deposited onto an adhesive coating on the fabric. The present yarn is further useful in producing fire resistant flame barrier fabrics for use beneath upholstery fabric.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. A fire resistant coated fabric comprising a fine textured fire resistant flame barrier lightweight fabric substrate formed of a nonlively nonplied corespun yarn comprising an air jet spun yarn without any appreciable twist and including a core of high temperature resistant continuous filament fiberglass constituting about 20% to 40% of total weight of the corespun yarn, and a sheath of low temperature resistant staple fibers surrounding and covering said core and constituting about 80% to 60% of the total weight of said corespun yarn, and a coating substantially completely covering and adhered to one side of said fabric.

2. A fire resistant coated fabric according to claim 1 wherein said coating comprises a thermoplastic polyvinyl halide composition in a thickness of between 20 to 50 mils so that when said coated fabric is exposed to flame, the coating and the sheath of the yarn forming the fabric substrate burn and char and provide a flame-durable non-ruptured barrier to the penetration of flame through the coated fabric.

3. A coated fabric according to claims 1 or 2 wherein said fabric substrate comprises a knit fabric.

4. A coated fabric according to claim 1 wherein said coating comprises a top layer of plasticized PVC of between 5 to 10 mils in thickness, and an intermediate layer of foamed PVC of from about 15 to 40 mils.

5. A coated fabric according to claim 1 wherein said sheath of low temperature resistant fibers comprises polyester fibers.

6. A coated fabric according to claim 5 wherein said polyester fibers comprise about 60% of the total weight of said corespun yarn, and wherein said fiberglass core comprises about 40% of the total weight of said corespun yarn.

7. A coated fabric according to claim 1 wherein said sheath of low temperature resistant fibers comprises cotton fibers.

8. A coated fabric according to claim 7 wherein said cotton fibers comprise about 60% of the total weight of said corespun yarn, and wherein said fiberglass core comprises about 40% of the total weight of said corespun yarn.

9. A coated fabric according to claim 1 wherein said sheath of low temperature resistant fibers is selected from the group consisting of wool, cotton, polyester, modacrylic nylon, rayon, acetate, and blends of these fibers.

* * * * *